US005602577A

United States Patent [19]

Shibata et al.

[11] Patent Number: 5,602,577

[45] Date of Patent: Feb. 11, 1997

[54] HUMIDIFIER APPARATUS FOR FLUID-CONTAINING TUBES AND AN IMPROVED INK-JET PRINTER UTILIZING THE APPARATUS

[75] Inventors: Alan Shibata, Camas, Wash.; Bruce Cowger, Corvallis, Oreg.

[73] Assignee: Hewlett-Packard Company, Palo Alto, Calif.

[21] Appl. No.: 279,752

[22] Filed: Jul. 21, 1994

[51] Int. Cl.[6] ..... B41J 2/17

[52] U.S. Cl. ..... 347/84; 347/35

[58] Field of Search ..... 347/84, 85, 22, 347/23, 35, 26, 28, 102

[56] References Cited

U.S. PATENT DOCUMENTS

| | | |
|---|---|---|
| 4,228,442 | 10/1980 | Krull . |
| 4,412,233 | 10/1983 | Thomas et al. . |
| 4,484,202 | 11/1984 | Sayko . |
| 4,600,927 | 7/1986 | Sugitani . |
| 4,852,485 | 8/1989 | Brunner . |
| 5,025,270 | 6/1991 | Umezawa . |
| 5,210,550 | 5/1993 | Fisher et al. . |
| 5,289,213 | 2/1994 | Murai et al. . |

FOREIGN PATENT DOCUMENTS

| | | | |
|---|---|---|---|
| 9335613A1 | 10/1989 | Germany . | |
| 57-83488 | 5/1982 | Japan . | |
| 58-208061 | 3/1983 | Japan . | |
| 61-27259 | 2/1986 | Japan . | |
| 62-288045 | 12/1987 | Japan . | |
| 63-260450 | 10/1988 | Japan | 347/23 |
| 10-71756 | 3/1989 | Japan | 347/102 |
| 2-175158 | 6/1990 | Japan . | |

*Primary Examiner*—John E. Barlow, Jr.

[57] ABSTRACT

Humidifying apparatus including a sealable humidity chamber for fluid-containing tubes are described for use, for example, in an ink-jet printer. The ink-delivery tubes are temporarily stored in the chamber when the printhead is not in use. The chamber is humidified preferably by vaporized ink constituents that have similar properties with those of the ink within the tubes. This is accomplished in accordance with the preferred embodiment of the invention by placing at least the spittoon portion of the printhead's service station also within the chamber, as such provides a ready supply of ink vapor. In a preferred embodiment, four tubes containing four differently colored inks are configured in a spaced, substantially planar array and made compactly to bend in accordion fashion when the printhead is moved to the chamber side of the printer's carriage such that a printhead-mounted lid is pressed into sealing engagement with and closure of the chamber.

14 Claims, 3 Drawing Sheets

HUMIDIFIER APPARATUS FOR FLUID-CONTAINING TUBES AND AN IMPROVED INK-JET PRINTER UTILIZING THE APPARATUS

TECHNICAL FIELD

The present invention relates generally to fluid delivery systems such as those found in ink-jet printers. More particularly, the invention concerns providing humidifier apparatus in the form of a sealable humidity chamber in the housing of a device such as an ink-jet printer, with a reciprocable carriage-mounted printhead being movable thereinto when not in use, thereby to seal the flexible ink-delivery tubes that extend between the printhead and the ink source inside an environment that minimizes diffusion of volatile ink constituents through the tubes' sidewalls.

BACKGROUND ART

Previously, the tendency of ink constituents to diffuse through the walls of ink-delivery tubes has been overcome by thickening or hardening the walls, at increased cost, weight and stiffness of the tubes, which must flex thousands of cycles over the life of an ink-jet printer and which should minimally load the dynamics of printhead carriage motion. This difficult tradeoff has produced only marginally improved ink delivery systems that still are subject to twisting of tubes that may produce torque on the printhead, high diffusion rates and high product and maintenance costs.

DISCLOSURE OF THE INVENTION

Briefly, the invention provides a sealable humidity chamber in which fluid-delivery tubes extending between a stationary fluid reservoir and a movable mechanism such as a printhead are temporarily stored when the mechanism is not in use. The chamber is humidified preferably by vaporized ink constituents that have similar properties with those of the ink within the tubes. This is accomplished in accordance with the preferred embodiment of the invention by placing at least the spittoon portion of the printhead service station also within the chamber, as such provides a ready supply of ink vapor. In a preferred embodiment, four tubes containing four differently colored inks are configured in a spaced, substantially segment-wise-planar array and made compactly to bend in accordion folded fashion when the printhead is moved to the chamber side of the printer's carriage such that a printhead-mounted lid is pressed into sealing engagement with and closure of the chamber. Thus, the chamber's volume is reduced and the ink-jet printer's small footprint substantially is maintained.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
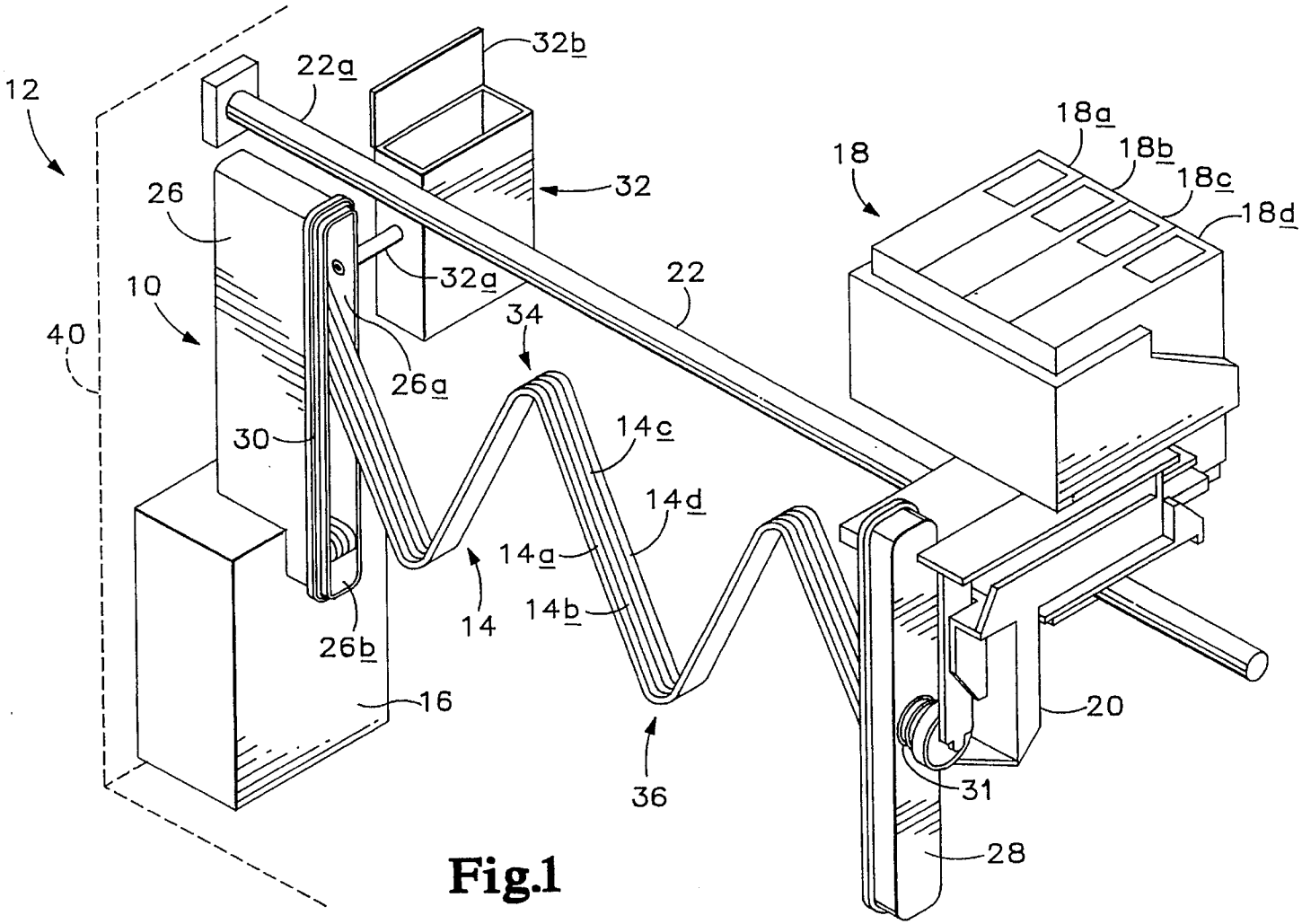
FIG. 1 is an isometric view of the invented humidifier apparatus made in accordance with a preferred embodiment.
Figure 2:
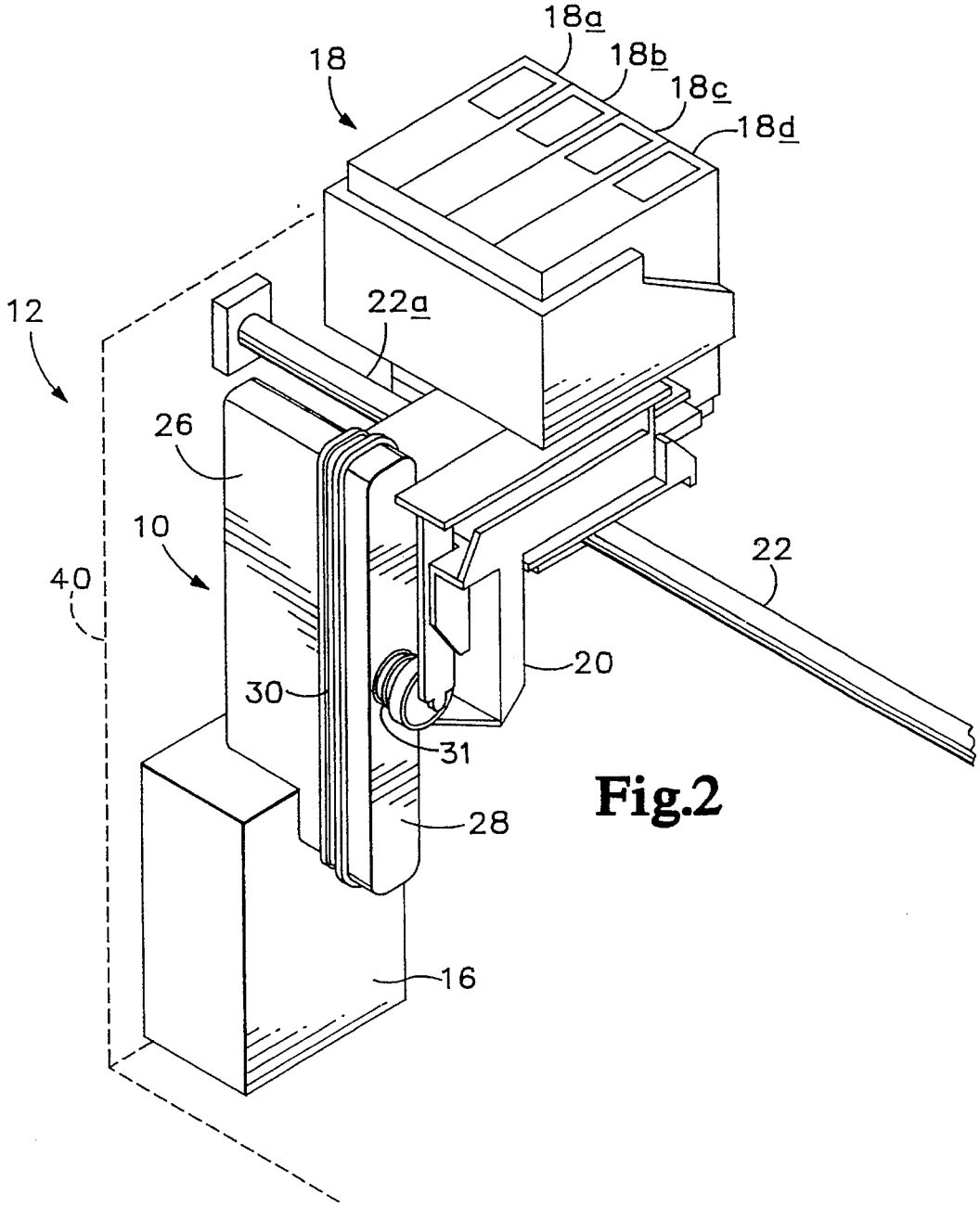
FIG. 2 is an isometric view corresponding with FIG. 1 but showing the apparatus in a different phase of operation with the flexible tubing structure extended.
Figure 3:
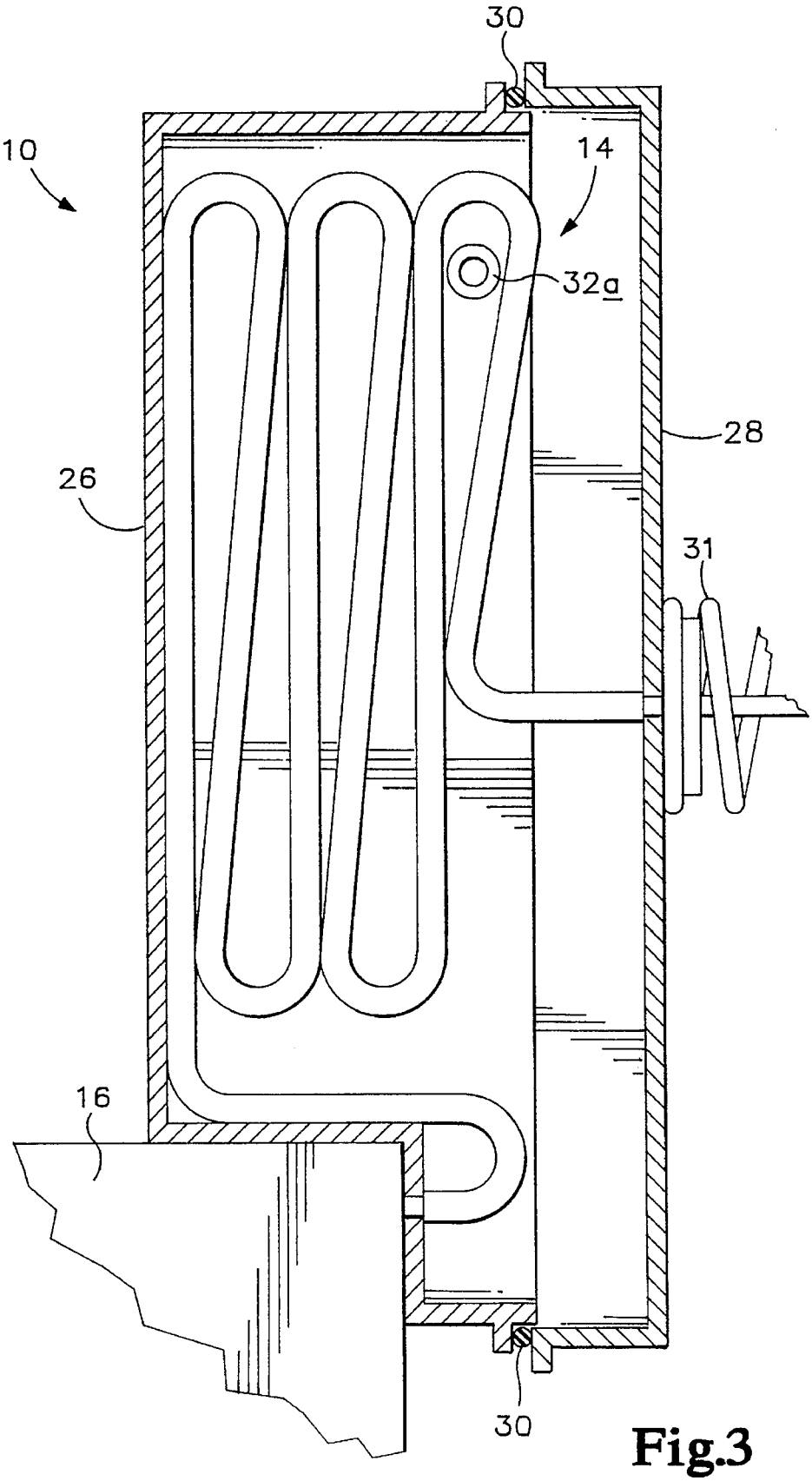
FIG. 3 is a fragmentary front elevational view taken generally along the lines 3—3 of FIG. 1, and shows the flexible tubing structure in its folded configuration within the humidity chamber.

Referring collectively to FIGS. 1 through 3, the invented humidifier apparatus in its preferred embodiment is indicated generally at 10. Apparatus 10 is useful in a device 12 having one or more flexible tubes indicated generally at 14, such as unitarily joined plural tubes 14*a*, 14*b*, 14*c*, 14*d*, extending between at least one stationary fluid reservoir 16 and a mechanism 18 movable by a carriage 20 along a track 22. In one notable embodiment described and illustrated herein, device 12 is an ink-jet printer, a fluid 24 within tubes 14 is ink and mechanism 18 is a printhead, as will be more fully described below. Nevertheless, those skilled in the art will appreciate that other devices, fluids and mechanisms utilizing the invented apparatus are within the spirit and scope of the invention.

Humidifier apparatus 10 may be seen preferably to include a chamber 26 adjacent a first, or one, end 22*a* of track 22. Chamber 26 preferably defines an interior void, indicated at 26*a*, and has an opening 26*b* thereinto for receiving through opening 26*b* and within void 26*a* the one or more tubes, e.g. one or more and preferably all of tubes 14*a*, 14*b*, 14*c*, 14*d*. Further, chamber 26 provides for fluid connection between reservoir 16 and the one or more tubes 14, with opening 26*b* of the chamber being sealable by the lidded closure of the opening while the one or more tubes is received therein.

Apparatus 10 also may be seen from FIGS. 1 through 3 preferably to include a lid 28 connected with mechanism 18 and movable therewith. Lid 28 provides for selected sealing engagement with chamber 26 to close opening 26*b* when the mechanism is moved into predefined proximity with one end 22*a* of the track. Such lidded engagement is best shown in FIGS. 2 and 3, and preferably is assisted by a gasket, e.g. a compressible O-ring 30 made, for example, of rubber.

Chamber 26 is chargeable with a vapor atmosphere, indicated within void 26*a* as stacked dashed lines, characterized by a humidity level that reduces diffusion of fluid 24, e.g. ink, through what will be understood to be the cross-sectionally circumferential sidewalls of One or more tubes 14. In accordance with a preferred embodiment, this chamber charging function is performed by a chamber charger 32 operatively coupled with chamber 26 to charge the chamber with a predefined vapor atmosphere characterized by a humidity level that reduces ink particulate diffusion through the sidewalls of one or more tubes 14. As will be described below, preferably chamber charger 32 takes the form of a spittoon that forms a part of an ink-jet printer, which spittoon may be of conventional design so long as it is located, in accordance with invention, within chamber 26 thus to charge it with a vapor atmosphere.

As noted, apparatus 10 has been found to be particularly useful when device 12 is an ink-jet printer and when mechanism 18 is a printhead. In such case as is illustrated herein the chamber is vapor communicatively coupled with a spittoon for the printhead indicated by reference designator 32 in FIG. 1, the spittoon having a predefined capacity to receive ink spitted thereat by the printhead. Spittoon 32 communicates ink vapor to chamber 26 via a connecting tube or hose 32*a*. It preferably is sealably lidded as indicated schematically at 32*b*, which lid may be automatically opened and closed under control of a servo motor connected with the printer's controller. Thus, the spittoon charges chamber 26 with such vapor atmosphere. Those skilled in the art will appreciate that printhead mechanism 18 may also be used as a chamber charger, since it is believed that chamber 26 need only the slightest charge of ink vapor effectively to reduce vapor diffusion. Thus, it is within the spirit and scope of the invention to charge chamber 26 simply by "parking" a wet ink-containing printhead mechanism within a sealable chamber containing the ink-delivery tube(s).

As may be seen best from FIGS. 2 and 3, tubes 14 of apparatus 10 are structurally predisposed to settle compactly within void 26*a* of chamber 26 when mechanism 18 is moved toward one end 22*a* of track 22. Preferably, such structural predisposition is to fold in plural predefined regions such as regions 34, of one or more tubes 14 substantially in a back-and-forth motion, as suggested. Alternatively, such structural predisposition is to form a helical coil of the one or more tubes 14. This latter predisposition is described and illustrated in co-pending U.S. patent application Ser. No. 08/249,500 entitled "FLUID-DELIVERY SYSTEM INCLUDING COILED CONCENTRIC TUBES", which was filed May 26, 1994, and which is subject to common ownership herewith.

A relatively small volume of void 26*a*, e.g. preferably less than approximately 0.5 liter, reduces the perimeter and space impact of the invention on conventional ink-jet printers, which typically are of minimal volume and footprint. It will be appreciated that such a small volume for void 26*a* of chamber provides invented apparatus 10 with what might be referred to as high functional density. (Functional density is further increased in accordance with the preferred embodiment of the invention by incorporating within chamber 26 a spittoon for receiving waste fluid expelled from mechanism 18.)

Those skilled in the art will appreciate that it is the invented structure of tubes 14 that permits them to flex and extend—as required to deliver one or more fluids to a reciprocally movable carriage-mounted mechanism—and that also predisposes them to settle compactly, for temporary storage, in chamber 26, as required in applications that are space limited. Tubes 14 may be constructed in accordance with co-pending U.S. Pat. No. 5,473,354 entitled "INK-DELIVERY APPARATUS", filed May 26, 1994, which is subject to common ownership herewith.

The invention may be seen to include also more conventional elements of ink-jet printers in useful combination with the features described above, thereby producing an improved ink-jet printer indicated generally at 12. Improved printer 12 thus preferably also includes 1) a housing, indicated in dashed outline at 40; 2) an elongate track 22 connected with the housing, the track being oriented parallel with a print axis of the printer; and 3) a carriage 20 for mounting a printhead, the carriage being movable reciprocally along the track.

Improved printer 12 further preferably includes 4) a printhead 18 mounted on the carriage, the printhead including one or more pens 18*a*, 18*b*, 18*c*, 18*d* corresponding to the printing of one or more colors such as cyan, magenta, yellow and black; 5) an ink reservoir 16 (of which there of course may be one or more) containing the one or more inks of different colors, the one or more reservoirs being fixedly positioned relative to the housing adjacent a first end, e.g. one end 22*a*, of the track; and 6) one or more flexible ink-delivery tubes such as tubes 14*a*, 14*b*, 14*c*, 14*d* extending between the one or more ink reservoirs and the one or more (corresponding) ink pens of the printhead. tubes 14*a*, 14*b*, 14*c*, 14*d* extending between the one or more ink reservoirs and the one or more (corresponding) ink pens of the printhead.

Those skilled in the art now will appreciate that, while the invented humidifying apparatus has been described as usable particularly in the context of ink-jet printers, it finds broader utility in any application having one or more flexible tubes extending between a relatively stationary fluid-supplying reservoir and a relatively movable fluid-consuming mechanism where the fluid within the one or more tubes is subject to evaporation or diffusion through the tube's sidewall. Thus, apparatus involving alternative fluids, devices and mechanisms will be understood to be within the spirit and scope of the invention.

INDUSTRIAL APPLICABILITY

It may be seen then that the invented apparatus finds general and specific utility where fluid-containing flexible tubes are subject to undesirable diffusion of the liquid through the tube's sidewall. Greatly reduced diffusion is achieved in accordance with invention by maintaining the liquid-containing tube compactly within the void of a sealable chamber that takes up little space within the device's housing. When used in the illustrated ink-jet printer context, there is required no additional means for humidifying the chamber when, in accordance with the preferred embodiment of the invention, the spittoon into which ink periodically is spitted by the printhead is vapor-communicatively coupled with the chamber, thereby providing humidification of the chamber and the contained tubes without incremental cost.

While the present invention has been shown and described with reference to the foregoing preferred embodiment, it will be apparent to those skilled in the art that other changes in form and detail may be made therein without departing from the spirit and scope of the invention as defined in the appended claims.

We claim:

1. A humidifier apparatus for use in a device having a stationary fluid reservoir and a mechanism movable by a carriage along an elongate track, said humidifier apparatus comprising:

one or more flexible tubes having sidewalls and extending between the fluid reservoir and the mechanism;

a chamber adjacent a one end of the track, said chamber defining an interior void and having an opening thereinto for receiving through said opening and within said void said one or more tubes, said chamber providing for fluid connection between the reservoir and said one or more tubes; and a lid connected with the mechanism and movable therewith, said lid providing for selected sealing engagement with said chamber to sealably close said opening with said tubes therein when the mechanism is moved into predefined proximity with such one end of the track, said chamber including a vapor atmosphere characterized by a humidity level that reduces fluid diffusion through sidewalls of said one or more tubes.

2. The apparatus of claim 1 in which the device is an ink-jet printer and the mechanism is a printhead, wherein said chamber is vapor-communicatively coupled with a spittoon for the printhead, said spittoon having a predefined capacity to receive ink spitted thereat by the printhead, said spittoon charging said chamber with said vapor atmosphere.

3. The apparatus of claim 1 in which the tubes are structurally predisposed to settle compactly within said void of said chamber when the mechanism is moved toward the one end of the track.

4. The apparatus of claim 3, wherein such structural predisposition is to fold in plural predefined regions of the one or more tubes substantially in a back-and-forth motion.

5. The apparatus of claim 3, wherein such structural predisposition is to form a helical coil of the one or more tubes.

6. An improved ink-jet printer comprising:

a housing;

an elongate track connected with said housing, said track being oriented parallel with a print axis of the printer;

a carriage for mounting a printhead, said carriage being movable reciprocally along said track;

a printhead mounted on said carriage, said printhead including one or more pens corresponding to the printing of one or more colors;

one or more ink reservoirs containing one or more inks of different colors, said reservoirs being fixedly positioned relative to said housing adjacent a first end of said track;

one or more flexible ink-delivery tubes extending between said one or more ink reservoirs and said one or more ink pens of said printhead;

a humidity chamber connected with said housing, said chamber being located adjacent a first end of said track in predefined alignment with said carriage, said chamber including an internal void and an opening thereto facing said carriage with said void being dimensioned to receive therein said one or more tubes in a predefinedly compacted configuration, said chamber providing for fluid connection between said one or more ink reservoirs and said one or more tubes, said opening of said chamber being sealable by closing said opening while said one or more tubes is received therein; and a lid connected with said printhead and movable therewith, said lid providing for selected sealing engagement with said chamber to close said opening when said printhead is moved into predefined proximity with said first end of said track, said chamber being chargeable with a vapor atmosphere characterized by a humidity level that reduces ink particulate diffusion through the sidewalls of said one or more tubes.

7. The printer of claim 6, wherein said chamber is vapor-communicatively coupled with a spittoon for said printhead, said spittoon having a predefined capacity to receive ink spitted thereat by said printhead, said spittoon charging said chamber with such vapor atmosphere.

8. The printer of claim 6, wherein said tubes are structurally predisposed to settle compactly within said void of said chamber when said printhead is moved toward said first end of said track.

9. The printer of claim 8, wherein such structural predisposition is to fold in plural predefined regions of said one or more tubes substantially in a back-and-forth motion.

10. The printer of claim 8, wherein such structural predisposition is to form a helical coil of said one or more tubes.

11. A humidifier apparatus for use in an ink-jet printer having a stationary ink reservoir and a printhead mechanism movable by a carriage along a track, said humidifier apparatus comprising:

one or more flexible tubes having sidewalls and extending between the ink reservoir and the printhead mechanism:

a chamber adjacent one end of the track, said chamber defining an interior void and having an opening thereinto for receiving through said opening and within said void said one or more tubes, said chamber providing for fluid connection between the ink reservoir and said one or more tubes;

a lid connected with the printhead mechanism and movable therewith, said lid providing for selected sealing engagement with said chamber to sealably close said opening with said one or more tubes therein when the printhead mechanism is moved into predefined proximity with the one end of the track; and a chamber charger operatively coupled with said chamber to charge said chamber with a predefined vapor atmosphere characterized by a humidity level that reduces ink particulate diffusion through sidewalls of said one or more tubes.

12. The apparatus of claim 11, wherein said chamber charger includes a spittoon for the printhead mechanism, said spittoon having a predefined capacity to receive ink spitted thereat by the printhead mechanism.

13. The apparatus of claim 12 in which the tubes are structurally predisposed to settle compactly within said void of said chamber when the printhead mechanism is moved toward the one end of the track.

14. The apparatus of claim 13, wherein such structural predisposition is to fold in plural predefined regions of the one or more tubes substantially in a back-and-forth motion.

* * * * *